United States Patent [19]

Hawkins

[11] Patent Number: 4,583,925

[45] Date of Patent: Apr. 22, 1986

[54] SUCTION PUMP

[75] Inventor: Alfred J. Hawkins, Riverside, Calif.

[73] Assignee: Irrometer Company, Inc., Riverside, Calif.

[21] Appl. No.: 657,375

[22] Filed: Oct. 3, 1984

[51] Int. Cl.[4] ..... F04B 21/02

[52] U.S. Cl. ..... 417/555 R; 137/539; 137/903; 141/65

[58] Field of Search ..... 417/555 R; 92/168; 137/539, DIG. 4; 403/50, 51, 197; 141/65

[56] References Cited

U.S. PATENT DOCUMENTS

| | | | |
|---|---|---|---|
| 1,601,705 | 9/1926 | Staunton | 141/65 |
| 2,577,417 | 12/1951 | Halpin | 417/555 R |
| 2,648,474 | 8/1953 | Crook | 141/65 |
| 2,883,939 | 4/1959 | Russell | 417/555 R |
| 4,072,291 | 2/1978 | Adams | 137/DIG. 4 |
| 4,185,721 | 1/1980 | Karklins et al. | 92/168 |
| 4,249,583 | 2/1981 | Lundbladh | 141/65 |
| 4,287,819 | 9/1981 | Emerit | 417/555 R |
| 4,315,601 | 2/1982 | Brooker | 137/539 |
| 4,375,825 | 3/1983 | Greenspan | 137/DIG. 4 |

*Primary Examiner*—Carlton R. Croyle
*Assistant Examiner*—Donald E. Stout
*Attorney, Agent, or Firm*—Donald D. Mon

[57] ABSTRACT

A suction pump which includes a valving member including a one way check valve, a cylinder and sliding cup seal connected to said check valve so that a negative pressure can be developed by the pump. The valving member includes a valving seat, a valving ball, and a plurality of biasing leaflets. The valving body less the ball is preferably formed as an integral elastomeric body. The seal makes a sliding seal in the direction of evacuating movement, and deflects to permit air to by-pass it in the other direction.

11 Claims, 4 Drawing Figures

SUCTION PUMP

FIELD OF THE INVENTION

This invention relates to a suction pump.

BACKGROUND OF THE INVENTION

Hand held, hand-actuated suction pumps are generally known. Classically they include a plunger inside a cylinder and some arrangement of two serially connected check valves. One of the check valves enables air to be withdrawn from a region to be evacuated and prevents reverse flow into that region. The other of the check valves enables air to be drawn into the cylinder through the first check valve, and passes air to be discharged to the atmosphere without returning it to its source.

In view of the long history and simplicity of such pumps and of their wide application, it is surprising that unmet objectives continue to exist. But they do, and this invention was made to meet some of them.

For example most suction pumps have rather complicated check valves that can easily be clogged up by particulate material. When such pumps are used in agricultural work, they break down too readily. It is an object of this invention to provide a rugged suction pump that can be assembled from simple parts, which is not as subject to clogging up, and whose most critical parts can inexpensively be formed by molding processes.

BRIEF DESCRIPTION OF THE INVENTION

A suction pump according to this invention includes a valving element comprising a first check valve that is to communicate with a region to be evacuated, for example with the mouth of a reservoir to be de-aired.

To this valving element there is attached a tubular element that has a cylindrical bore within which there is fitted a sliding plunger having a cup seal directed away from the first check valve. Actuator means such as a plunger rod is connected to the seal so as to move it axially in the cylinder. The flange of the seal makes a fluid sealing contact with the wall of the cylinder when moved away from the first valve so as to create an enlarging plenum of decreasing pressure when it is moved in this direction, and which seal recedes from the wall of the cylinder when moved in the opposite direction to permit air within the plenum to blow past the seal to the atmosphere. This seal, with the wall of the cylinder, acts as a second check valve, as well as a piston which enlarges the plenum.

According to a preferred feature of the invention, the valving element comprises a passage in which there is disposed a valve seat, and a ball adapted to bear against the seat in a fluid sealing manner in one position and to recede from it in another. On the opposite side of the center of the ball from the valve seat there is at least one leaflet integral with the valving member which yieldingly tends to bias the ball toward the valve seat. This inherent bias is sufficient to maintain the seal between the ball and the ball seat.

As an optional feature, a suction cup can be connected to the valving element to assist in providing a leak-proof fluid conduit to the valving element.

The above and other features of this invention will be fully understood from the following detailed description and the accompanying drawings, in which:

BRIEF DESCRIPTION OF THE DRAWINGS

FIG. 1 shows a suction pump 10 according to the invention. It is shown brought against a surface 11, such as the mouth of reservoir 12. In this application, a negative pressure is to be generated in the reservoir, perhaps to de-air it.

Figure 1:
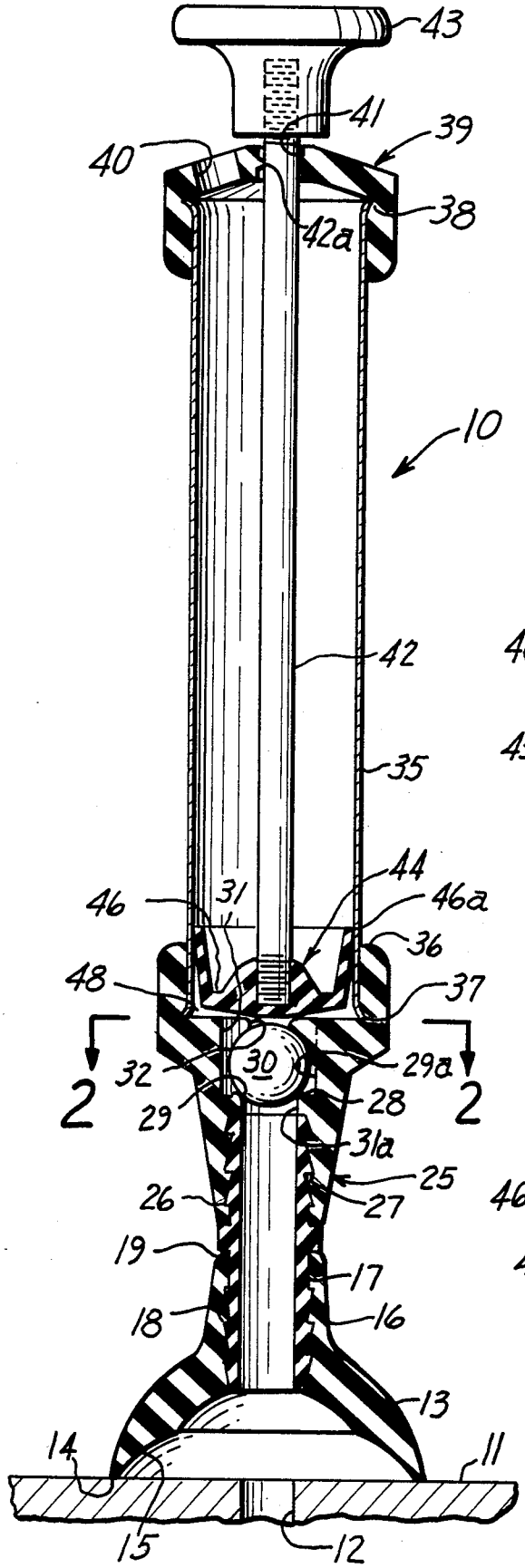
FIG. 1 is an axial cross-section of the presently preferred embodiment of the invention.
Figure 2:
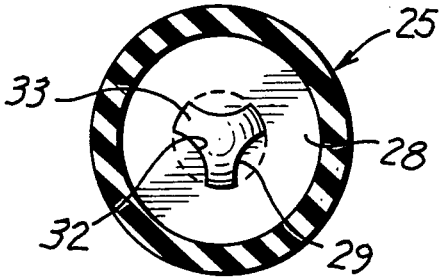
FIG. 2 is a cross-section taken at line 2—2 of FIG. 1.

The suction pump is provided with a cup 13 having a peripheral edge 14 and a sealing face 15. The face is cup-like. When negative pressure is generated, the sealing face moves toward surface 11 an makes a substantial and continous surface-to-surface contact so the pump can conveniently and repetitively be actuated. Negative pressure will hold the suction cup in this deformed condition. The cup can be released by prying it up at its edge.

The suction cup includes a tubular neck 16 within which a conventional tubular connector 17 is fitted. The connector has typical saw-tooth peripheral ridges 18 which tend to embed themselves into the material of the neck to resist removal and to make a fluid seal. A shoulder 19 limits the entry of the connector into the suction cup.

A valving member 25 includes a tubular neck 26 into which the other end of the connector is inserted. This end of the connector also has peripheral saw-tooth ridges 27 to retain it in place and to make a fluid seal. A circular valve set 28 with a valving edge 29 or face extends around passage **29*a* in neck 26. It is preferably spaced from the wall 31*a* of a cylindrical pasage 31, to give more resilience to the seal. The abutment of the connector against shoulder 19 gives some additional axial support to the seal. Inside the neck there is placed a spherical valving ball 30. It fits in cylindrical passage 31 and is restrained there by a plurality of leaflets 32** that are formed integrally with the material of the valving member. The valving member is made of cast elastomeric material so that, while deflection of the leaflets is possible, it requires force for the deflection to occur. The leaflets therefore inherently bias the ball toward the valve seat. This a creates biasing force against the valve seat which must be overcome by the pump when the negative pressure is being generated, and the dimensions and strength of the leaflets are criteria to be considered in designing this device. Conveniently three of these leaflets are provided, although more or fewer could be used instead. The valving member can be cast in a mold on a core, and the core can be stripped out after the part is removed from the mold.

Bypass passages 33 are formed between the leaflets so as to permit air to pass between the leaflets when the pumping action is being exerted. The diameter of passage 31 is somewhat greater than the diameter of the valving ball so that air can pass by the ball during the pumping action. Alternatively, bypass grooves (not shown) can be formed in the wall of the passage for this purpose.

Figure 3:
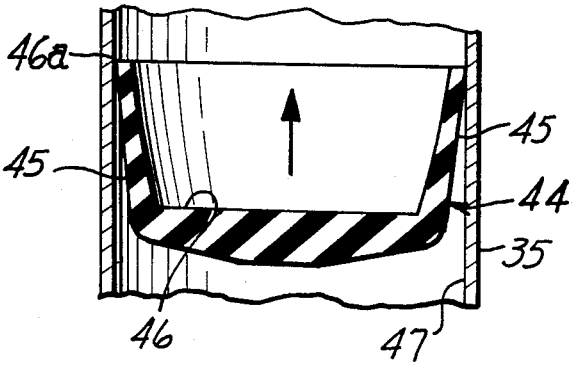
FIGS. 3 and 4 are fragmentary axial sections showing the cup seal in two operating conditions.
Figure 4:
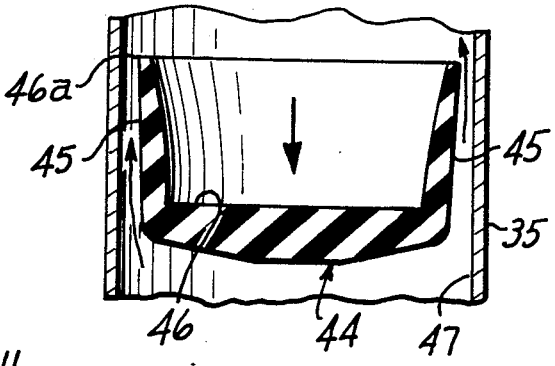

A cylinder 35 comprising a piece of metal tubing is thrust into the passage through the valving member at the open end 36 of the valving member. It conveniently has flared ends 37, 38 which indent into the elastomeric material but which permit removal by exertion of sufficient force. This indentation and the friction between the cylinder and the valving member make a releasable joinder of the two. At its end farthest removed from the valving element, there is a cap 39 similarly fitted over flare 38. The cap may also be made of elastomeric material so as readily to be attached to and detached from the cylinder. The cap has a vent port 40 and an opening 41 to pass a pump rod 42. A rib 42*a* in opening 41*b* through the cap reduces the area of contact between the cap and the rod, so as to minimize grab and frictional drag during operation. A handle 43 is attched to the upper end of the pump rod. The lower end is threaded to a sliding cup seal 44 which has a peripheral flexible flange 45 and a central base 46. The flange has a contact edge 46*a*. When the sliding seal is pushed downardly (FIG. 4) it collapses and air can blow past the contact edge. But when it is raised (FIG. 3), the contact edge will be pressed outwardly in contact with the inside cylindrical wall 47 of cylinder 35 so as to enable the generation of a negative pressure in an enlarging plenum 48 beneath the sliding seal and in communication with the first check valve. This will unseat the ball, and enable air to be drawn through the first check valve.

By definition, the first check valve comprises valve seat 28 and valving ball 30. The second check valve constitutes sliding seal 44 and wall 47 of cylinder 35.

In use, the cup is pressed against a surface surrounding a region to be de-aired, and the rod is repetitively cycled. The pump can be left in place as long as desired, or the cylinder could be removed, in both cases leaving the valving assembly in place with the negative pressure maintained. In either case, the mechanism is removed by prying up the edge of the cup to relieve the negative pressure.

It will be recognized that this device consists of readily manufactured, and in some cases standard items of manufacture. It is inexpensive and reliable, and is suitable for use in adverse situations such as in farming operations, where dirt in the system must be anticipated.

This invention is not to be limited by the embodiment shown in the drawings and described in the description which is given by way of example and not of limitation but only in accordance with the scope of the appended claims.

I claim:

1. A suction pump comprising:

a valving member having a body with a passage therethrough said passage having a peripheral axially extending wall, and comprising:

a valve seat in said passage;

a valve ball in said passage adapted to move against and away from said seat, said ball having lateral dimensions less than those of the passage, a leaflet on said body and in said passage so shaped and disposed and resiliently bearing against said valving ball as to trap it and hold it against said valve seat in the absence of a sufficient fluid force in said passage immediately downstream from said valve seat to displace the valve ball from the valve seat, said body and leaflet being made of elastomeric material, integral with one another, and inherently flexible and resilently resisting said displacement so that the leaflet must be deformed for the ball to leave the seat;

a cylinder having an internal cylindrical wall, said cylinder being attached to said valving member and communicating with said passage;

a cup seal in said cylinder having a flexible flange in sliding contact with said cylindrical wall and being sufficiently flexible as to deflect to permit passage of air in one direction of seal movement, and sufficiently shape retaining to make a sliding fluid-tight seal when moved in the opposite direction;

a plunger rod connected to said cup seal; and a structure fitted to the other end of said cylinder guiding and passing said rod.

2. A suction pump according to claim 1 in which said valve seat is formed integrally with said body.

3. A suction pump according to claim 2 in which there is a plurality of said leaflets, and said wall of said passage is relieved around part of its periphery between the leaflets to provide a fluid by-pass past the ball when the ball is displaced from the valve seat.

4. A suction pump according to claim 3 in which a suction cup is connected to said valving element.

5. A suction pump according to claim 1 in which there is a plurality of said leaflets.

6. A suction pump according to claim 1 in which said cylinder is removably mounted to said valving member, and is held to it by spring-back forces exerted by the material of said valving member.

7. A suction pump according to claim 6 in which the ends of the cylinder are outwardly flared to provide additional retention for the said cap and valving member to said cylinder.

8. A suction pump according to claim 1 in which said structure is a cap with a passage for said rod, said passage having an internal rib of short axial length to reduce drag load on the rod.

9. A suction pump according to claim 5 in which a suction cup is connected to said valving element.

10. A suction pump according to claim 6 in which a suction cup is connected to said valving element.

11. A suction pump according to claim 7 in which a suction cup is connected to said valving element.

* * * * *